US006087569A

United States Patent [19]

Gottschall

[11] Patent Number: 6,087,569

[45] Date of Patent: Jul. 11, 2000

[54] STEREOPHONIC MUSICAL STRING INSTRUMENT

[76] Inventor: Peter Gottschall, Rössleweg 3, D-88524 Uttenweiler, Germany

[21] Appl. No.: 09/211,329

[22] Filed: Dec. 15, 1998

[30] Foreign Application Priority Data

Dec. 16, 1997 [DE] Germany ..... 197 55 855

[51] Int. Cl.[7] ..... G10D 3/00

[52] U.S. Cl. ..... 84/291

[58] Field of Search ..... 84/291, 292, 293, 84/294, 173, 263, 267, 268, 297 R, 271, 269; D17/14, 20

[56] References Cited

U.S. PATENT DOCUMENTS

| | | | |
|---|---|---|---|
| 775,658 | 11/1904 | Isbell | 84/291 |
| 860,137 | 7/1907 | Inskeep | 84/291 |
| 906,612 | 12/1908 | Cayton | 84/291 |
| 954,487 | 4/1910 | Winecoff | 84/274 |
| 1,291,548 | 1/1919 | Kershner | 84/269 |
| 1,358,177 | 11/1920 | Roland | 84/274 |
| 1,409,078 | 3/1922 | Carlucci | 84/269 |
| 1,413,916 | 4/1922 | Kincannon | 84/274 |
| 1,455,916 | 5/1923 | Kalaf, Jr. | 84/274 |
| 1,510,019 | 9/1924 | Slingerland | 84/291 |
| 1,754,263 | 4/1930 | Claiborne | 84/267 |
| 2,204,150 | 6/1940 | Quattrociocche | 84/267 |
| 3,241,417 | 3/1966 | Meinel | 84/275 |
| 3,974,730 | 8/1976 | Adams | 84/291 |
| 4,027,570 | 6/1977 | Rendell et al. | 84/293 |
| 4,056,034 | 11/1977 | Kaman | 84/267 |
| 4,079,654 | 3/1978 | Kasha | 84/291 |
| 4,178,827 | 12/1979 | Mallory | 84/291 |
| 4,607,559 | 8/1986 | Armin | 84/275 |
| 4,873,909 | 10/1989 | Humphrey | 84/293 |
| 5,339,718 | 8/1994 | Leduc | 84/291 |
| 5,461,958 | 10/1995 | Dresdner et al. | 84/267 |
| 5,469,770 | 11/1995 | Taylor | 84/291 |
| 5,581,043 | 12/1996 | Bowar | 84/291 |

FOREIGN PATENT DOCUMENTS

| | | |
|---|---|---|
| 353939 | 7/1905 | France . |
| 2529363 | 12/1983 | France . |
| 47482 | 7/1966 | German Dem. Rep. . |
| 42521 | 3/1887 | Germany . |
| 1217757 | 5/1966 | Germany . |
| 2059972 | 6/1972 | Germany . |
| 19542487 | 6/1996 | Germany . |
| 3802245 | 3/1998 | Germany . |
| 17635 | 2/1905 | United Kingdom . |
| 703184 | 1/1954 | United Kingdom . |
| 1142486 | 2/1969 | United Kingdom . |
| 1161122 | 8/1969 | United Kingdom . |

*Primary Examiner*—Robert E. Nappi
*Assistant Examiner*—Kim Lockett
*Attorney, Agent, or Firm*—Karl Hormann

[57] ABSTRACT

A string instrument providing sound amplification without distortions by body formed of a belly and a back connected to each other by a rib such that the belly and the back are disposed at an angle relative to each other and wherein at least one sound opening is provided in the rib at the largest distance between the belly and the back.

2 Claims, 2 Drawing Sheets

STEREOPHONIC MUSICAL STRING INSTRUMENT

BACKGROUND OF THE INVENTION

Field of the Invention

The invention, in general, relates to an musical string instrument and, more particularly, to a stereophonic plucked string instrument provided with an arrangement for amplifying sound.

Musical instruments provided with a body consisting of ribs placed between a back and a belly provided with sound holes, end blocks, neck, fingerboard and bridge and a plurality of strings are very well known. They may be bowed or plucked. Plucked string instruments such as guitars, lutes, sitars, mandolins, vihuelas, theorbos and the like are all based on substantially the same operating principle. A string is either struck or plucked thereby imparting resonations to a resonance box by way of a bridge and the belly, the latter being usually disposed parallel with respect to the back. The strings, at one end, are either fastened to a tailpiece, or directly to the bridge, from where they extend, over the neck and fingerboard to a pegbox provided with pegs or the like for tuning the strings by tensioning them appropriately. The resonance box, commonly known as the body, essentially is a sound box provided with a sound hole. This principle which through the centuries has hardly been changed even until today, is acoustically limited in respect of sound level and bass reproduction because in terms of physics the sound box is not equipped with sound-amplifying components. If it is desired to achieve increased sound levels and an improved reproduction of the bass or low notes, it has hitherto necessary enlarge the sound box. While this does indeed improve sound level as well as bass reproduction, it results in a deterioration of high frequencies. Double-basses and violones may be mentioned as examples of string instruments with enlarged bodies.

German patent specification 195 42 487 discloses a plucked string instrument provided with a back extending in parallel to the belly and in the body of which there is provided an intermediate plate disposed at an inclination between the belly and the back. This instrument may be played in the normal fashion, and the intermediate plate does not result in a deterioration of high frequency sounds. Furthermore, the size of that instrument may be reduced while its sound quality remains unchanged, so that it leads to a reduced consumption of exotic woods. However, their manufacturing cost is higher, and in the case of a concert guitar using gut or synthetic strings a different sound spectrum results. Such instruments, owing to the composition of their strings, produce relatively good bass sounds; but high frequencies cannot attain the brilliance of steel stringed instruments. On the other hand, however, steel stringed instruments do not deliver the warm sound timbre of gut or nylon strung instruments.

OBJECTS OF THE INVENTION

It is a primary object of the invention to alter the shape of a body of a string instrument in a way yielding improved sound levels.

Another object of the invention is to provide an instrument of the kind referred to which provides improved sound amplification.

Yet another object of the invention is to provide a stringed instrument of improved and increased sound amplification without any reduction in its acoustic qualities.

Other objects will in part be obvious and will in part appear hereinafter.

BRIEF SUMMARY OF THE INVENTION

In accordance with the invention, there is provided a stringed instrument provided with a back extending at an inclination relative to the belly and having at least one sound hole in its rib. Preferably, the angle of inclination of the back relative to the belly is between 5° and 20°. The inclination is such that the shortest distance between back and belly is in the vicinity of the lower end block and opposite from the fingerboard. The sound hole is preferably located transversely of the neck and may be divided into two sections at opposite sides of the neck. In a particularly advantageous embodiment of the invention, the button of the neck is provided with a recess. In another advantageous embodiment of the invention plates are respectively provided between the button of the neck and the belly and the button and the back for providing an intimate connection between the neck, the back, the belly and the rib. Another improved embodiment of the invention calls for posts at opposite sides of the sound hole. In another advantageous embodiment of the invention the instrument is provided with bars fanning out radially from the lower end block. Another advantageous embodiment of the invention provides for a notched lining for connecting the back and the belly to the rib.

The body structured in accordance with the invention does not only improve the sound level of the instrument, but it also produces a very defined and transparent sound compared to conventional guitars, for instance. The transparency of its sound makes the instrument in accordance with the invention ideally suited for recordings as a solo instrument as well as together with other instruments. It is comfortable to play because of its reduced thickness in the area where the strings are attached. The lower end block and the rib are of a significantly reduced height and are, therefore, of a smaller mass and result in reduced dampening of the sound. Two sound openings are provided at the transition between the neck and the body. A sound hole in the rib may be made substantially larger and avoids the need to remove material from the belly. Over their entire surface area, the belly and the back form two opposite resonating plates and in the area of the lower end block they are spaced very closely together. The inclined disposition of the belly and the back relative to each other and the very large sound hole provide for an excellent funnel effect; and by providing a recess in the button of the neck on the side of the high sounds the thumb of a hand holding the neck is given an extended range of movement and makes it possible to play very high notes without any need for removing the hand from the neck. Static forces are absorbed by plates connected to the back, the belly and the button.

DESCRIPTION OF THE SEVERAL DRAWINGS

The novel features which are considered to be characteristic of the invention are set forth with particularity in the appended claims. The invention itself, however, in respect of its structure, construction and lay-out, as well as manufacturing techniques, together with other objects and advantages thereof, will best be understood from the following description of preferred embodiment when read with reference to the appended drawings, in which:

DETAILED DESCRIPTION OF PREFERRED EMBODIMENTS

Figure 1:
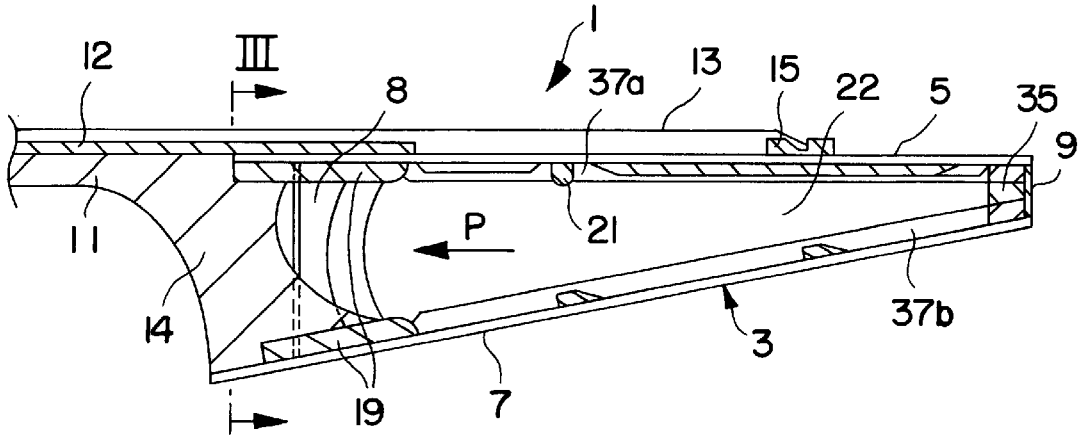
FIG. 1 is a longitudinal sectional view of the resonance body of a schematically shown plucked string instrument.
Figure 2:
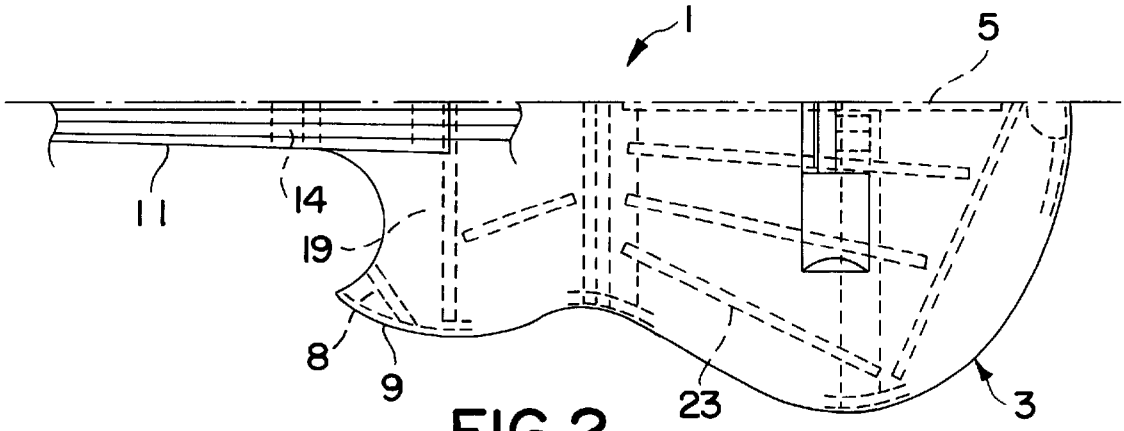
FIG. 2 is a partial top elevation of a schematically shown plucked string instrument provided with sound holes in the area of the lower end block.

FIG. 1 is a schematic presentation of a plucked or bowed string instrument 1 as exemplified by a concert guitar having a body 3. The body 3 is constructed of a belly 5 having a conventional bar structure and a back 7. The belly 5 and the back 7 are connected to each other by a rib 9 in a manner well known. In the left portion of the drawing, there is shown a section of the neck 11 and a fingerboard 12, as well as the connection of the neck with the back 7 and the belly 5 by means of a button 14. The other end of the neck 11 which may be provided with a peg box for tuning the strings of the instrument in the conventional manner has not been shown. One such string is shown at 13. It extends across a bridge 15 connected to the belly 5 and is fastened thereon. No sound hole is provided in the belly 5. A sound hole 17 is provided below the neck 11 and is seen to be divided by the button 14 of the neck 11 into two separate sections. It will be appreciated by those skilled in the art that the sections of the sound opening 17 may be of different sizes and configurations, depending on the type of instrument.

As shown in the schematic presentation of the body 3 in FIG. 1 the back 7 is disposed at an inclination with respect to the belly 5. The back 7 may be of planar, convex or concave configuration.

Figure 3:
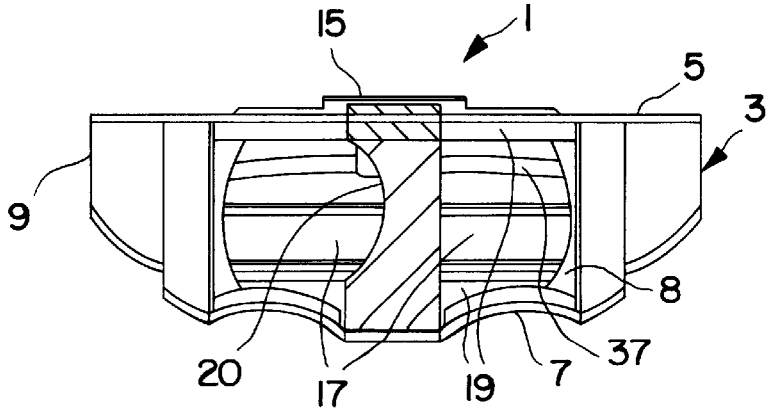
FIG. 3 is a cross-section along line III—III in FIG. 1 through the button of the neck and showing the sound holes.

The connection of the back 7 to the rib 9 is very closely adjacent to the belly 5. The sound hole 17 is formed in the area of the greatest height of a chamber 22 formed by the body 3. As has been mentioned supra, and in contrast to conventional instruments, the sound hole 17 is no longer positioned in the belly 5 but in the rib 9 or, as may be clearly seen in FIG. 3, between the button 14 of the neck 11 and the ends of the rib 9. The angle enclosed between belly 5 and back 7 is about 8°; but depending upon the size of the instrument or the height of the rib, the angle may be larger or smaller than 8°, e.g., between 5° and 20°.

As may be clearly seen in FIG. 1, the back 7 at its lower end closely approaches an upper lining 37*a* of the belly 5. In the embodiment shown, the height of the lower end block has been reduced to a few centimeters, and the two surrounding linings 37*a* and 37*b* of the belly 5 and back 7, respectively are placed very closely together. At the button 14 of the neck 11 forming the upper end block, the back 7 and the belly 5 are arcuately indented. This allows playing of higher notes. Advantageously, a recess 20 for accommodating the thumb of the hand is formed in the button 14 of the neck 11.

By plucking the string 13 or by moving a bow across it, the belly 5, by way of the bridge 15, will be subjected to oscillations and will emit high notes directly and in the same quality, as is conventional.

For reinforcing the body 3 in the area of the button 14 plates 19 are respectively mounted between the belly 5 and the button 14 and between the back 7 and the button 14. The plates 19 extend laterally of the rib 9 where they support posts 8 which together with the ends of the rib 9 limit the sound hole sections. The posts 8 are concavely curved near the openings thus providing for a maximum cross-sectional area of the openings 17.

Figure 4:
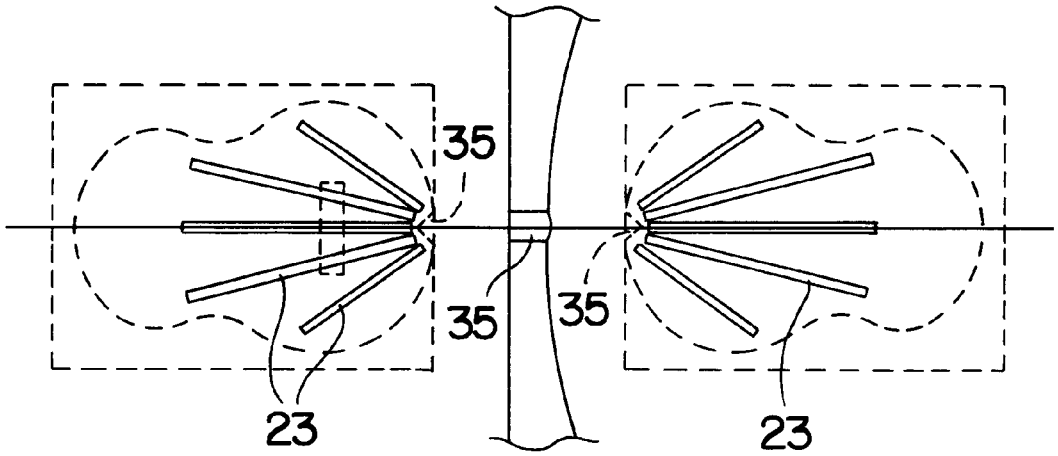
FIG. 4 is a schematic presentation of the bar structure on the belly and the back as well as a partial view of the rib in the area of the lower end block.

The cross bar 21 shown as an option as conventionally mounted in the area of the middle bout is actually no longer needed. Without the cross bar 21, the instrument will have a deeper sound timbre as the resonating surface of the belly 5 is enlarged by the omission of a cross bar. In order to provide the necessary stability bars 23 are arranged in a fan-like disposition, and they are longer than bars conventionally used in instruments of the kind under consideration. They may extend, beginning at the lower end block 35, across the major portion of the belly 5 and the back 7 (FIG. 4). The lower end block 35 forms the junction of the bars 23.

Figure 5:
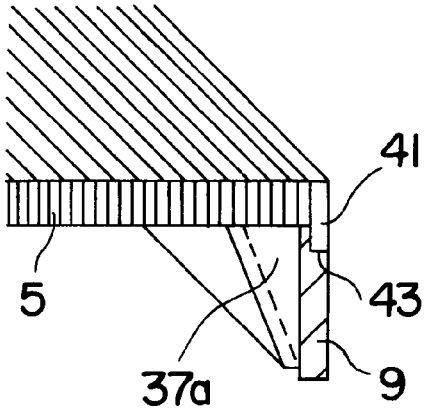
FIG. 5 is a partial cross-section of the rib and the belly.
Figure 6:
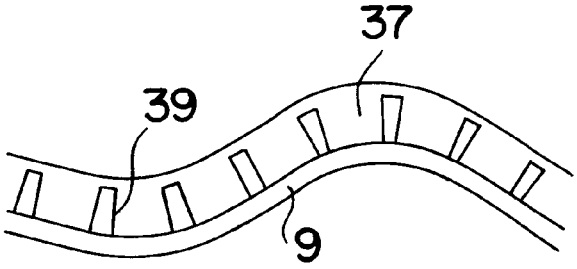
FIG. 6 is a partial longitudinal sectional view of the rib in the area of the lining.

In order further to improve the sound quality of the instrument, the linings 37*a* and 37*b* which connect the belly 5 and the back 7 to the rib 9 may be provided with notches 39 on their side engaging the rib 9. Their surface facing the interior is, however, smooth and continuous and does not dampen the sound (FIGS. 5 and 6).

The marginal strip or purling 41 covering the margin of the belly 5 and of the back 7 and which is seated in a groove 43 in the rib 9 preferably extends into the area of the button 14 of the neck 11 and extends around it.

What is claimed is:

1. A musical string instrument, comprising:

an elongate neck provided with an end portion;

a hollow body comprising a belly and a back connected to the end portion;

members within the body for the reinforcement thereof and secured to the end portion; and posts on opposite sides of the end portion and extending between the belly and the back, wherein the posts, the reinforcement members and the end portion define a sound hole divided into two sections disposed on opposite side of the end portion.

2. The instrument of claim 1, wherein the hollow body comprises a belly and a back disposed at an acute angle and diverging from each other in the direction of the end portion.

* * * * *